US006712647B2

(12) United States Patent
Khemakhem et al.

(10) Patent No.: US 6,712,647 B2
(45) Date of Patent: Mar. 30, 2004

(54) TERMINATED COAXIAL CONNECTOR

(75) Inventors: M'hamed Anis Khemakhem, Eden Prairie, MN (US); Jeff Peters, Eagan, MN (US); John David Schmidt, Shakopee, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 10/264,998

(22) Filed: Oct. 3, 2002

(65) Prior Publication Data

US 2004/0014363 A1 Jan. 22, 2004

Related U.S. Application Data

(63) Continuation-in-part of application No. 10/201,621, filed on Jul. 22, 2002, now abandoned.

(51) Int. Cl.[7] ..... H01R 13/66; H01R 33/945

(52) U.S. Cl. ..... 439/620; 439/133

(58) Field of Search ..... 439/620, 578, 439/133, 307

(56) References Cited

U.S. PATENT DOCUMENTS 3,302,159 A * 1/1967 Schumacher ..... 439/620
4,469,386 A * 9/1984 Ackerman ..... 439/133
4,660,921 A 4/1987 Hauver ..... 439/578
4,838,813 A * 6/1989 Pauza et al. ..... 439/620
5,011,422 A * 4/1991 Yeh ..... 439/307
5,046,968 A * 9/1991 Baur et al. ..... 439/620
5,730,612 A 3/1998 Tatsuzuki ..... 439/188
5,921,793 A 7/1999 Phillips ..... 439/188
6,019,622 A 2/2000 Takahashi et al. ..... 439/188

* cited by examiner

*Primary Examiner*—Hae Moon Hyeon
(74) *Attorney, Agent, or Firm*—Merchant & Gould P.C.

(57) ABSTRACT

A terminated coaxial connector having a mating end for mating with a coaxial jack, the connector including an axially aligned resistor mounted within a conductive outer shell. The resistor electrically links the outer shell with a center conductor which is connected to a first end of the resistor through a conductive rear plug which is connected to a second end of the resistor. The center conductor and the rear plug hold the resistor axially aligned within the outer shell. Further, a method of assembling a terminated coaxial connector having a mating end for mating with a coaxial jack so that a resistor within the connector is held axially aligned within an outer shell by a rear plug. The resistor is physically and electrically linked to the center conductor and the outer shell through the conductive rear plug and provides a level of impedance within the coaxial connector.

13 Claims, 6 Drawing Sheets

120
110
118
114
116
112

120
128
124
126
116
132
114
11
122
118

130
124
128
130
114
110
118
112
116
122

210
212
214
220
222
230
234
236
244
252
262
264
268
270
216
24
26
28
17

TERMINATED COAXIAL CONNECTOR

CROSS REFERENCE TO RELATED APPLICATIONS

This is a Continuation-in-Part of U.S. patent application Ser. No. 10/201,621 filed Jul. 22, 2002 now ABN.

FIELD OF THE INVENTION

The present invention relates to connectors for terminating coaxial telecommunications ports.

BACKGROUND OF THE INVENTION

In telecommunications installations, coaxial jacks are used to connect equipment at different locations within a telecommunications wiring closet or to other devices in the telecommunications system. It is not uncommon for jacks to be wired to one piece of equipment and not have a plug inserted in the jack to connect to a second piece of equipment. In these situations, it is desirable to insert a terminated plug in the jack to close the circuit and provide an appropriate level of impedance in the circuit as opposed to leaving the circuit open. The terminated plug will preferably provide a fixed and known amount of impedance matched to the particular requirements of the installation.

Known terminated plugs provide an outer shell and a center conductor connected directly by a resistor within and soldered to the outer shell. Known terminated plugs may not provide an stable or desirable level of impedance due to the resistor being angled within the outer shell, improperly contacting the outer shell or the solder connection between the outer shell and resistor being improper or inconsistent. Improvements to known terminated coaxial plugs are desirable.

SUMMARY OF THE INVENTION

The present invention relates to a terminated coaxial connector including a resistor to provide a desired level of impedance. The resistor is held within an conductive outer housing and electrically links a center conductor and the outer housing via an conductive end plug. The end plug is crimped about an end of the resistor and maintains the resistor in axial alignment within the outer housing. The present invention further relates to a method of assembling a terminated coaxial connector including a resistor wherein an end of the resistor is inserted within and crimped to a rear plug which holds the resistor axially aligned within a hollow core of a conductivew outer housing.

BRIEF DESCRIPTION OF THE DRAWINGS

The accompanying drawings, which are incorporated in and constitute a part of the specification, illustrate several aspects of the present invention, and together with the description, serve to illustrate the principles of the invention. A brief description of the drawings is as follows.

DETAILED DESCRIPTION OF THE PREFERRED EMBODIMENTS

Reference will now be made in detail to the exemplary aspects of the present invention that are illustrated in the accompanying drawings. Wherever possible, the same reference numbers will be used throughout the drawings to refer to the same or similar parts.

When terminating unused ports in a coaxial telecommunications installation, it is desirable to have terminated coaxial connectors with specific levels of impedance. For a BNC terminated coaxial plug connector, the desired level of impedance across the connector is 75 Ohms. For other types and styles of coaxial connectors, other levels of impedance may be preferred.

Figures 1, 2, 3:
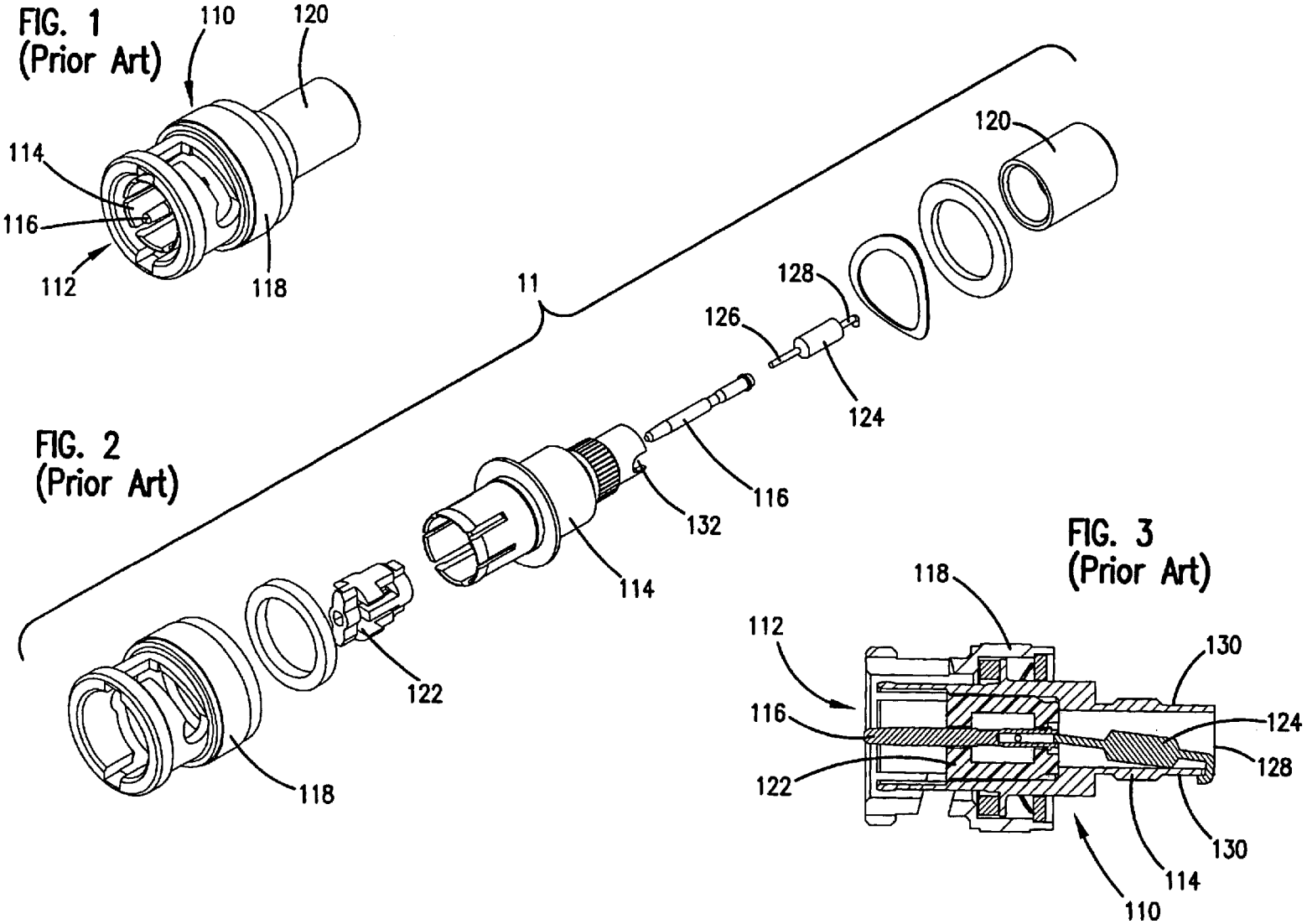
FIG. 1 (Prior Art)
FIG. 2 (Prior Art)
FIG. 3 (Prior Art)
FIG. 1 is a front perspective view of a prior art terminated coaxial connector.
FIG. 2 is an exploded front perspective view of the prior art terminated coaxial connector of FIG. 1.
FIG. 3 is a cross-sectional view of the prior art terminated coaxial connector of FIG. 1.
Figures 4, 5, 6, 7:
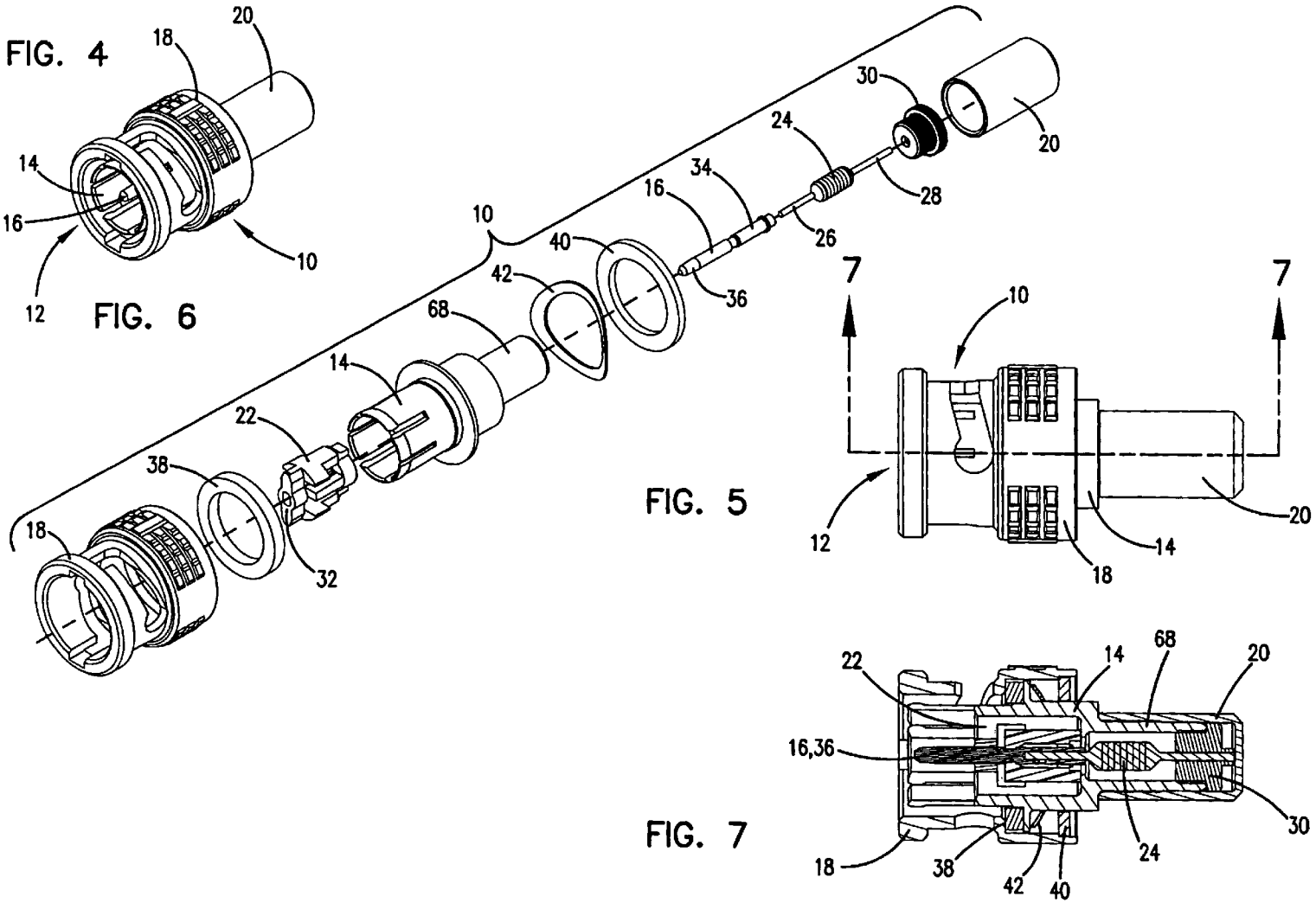
FIG. 4 is a front perspective view of a terminated coaxial connector in accordance with the present invention.
FIG. 5 is a side view of the terminated coaxial connector of FIG. 4.
FIG. 6 is an exploded front perspective view of the terminated coaxial connector of FIG.4.
FIG. 7 is a cross-sectional view of the terminated coaxial connector of FIG. 4 taken along line 7—7 in FIG. 5.

A prior art terminated coaxial plug connector 110 is shown in FIGS. 1 through 3 and includes a mating opening 112 for mating with a coaxial jack. A rotating locking mechanism 118 engages the coaxial jack to prevent inadvertent or accidental removal. Within a cylindrical conductive outer shell 114 is mounted an insulator 122 which electrical isolates a center conductor 116 substantially in the center of mating opening 112. A first lead or end 126 of a resistor 124 is mounted to center conductor 116 opposite mating opening 112 and electrically connects conductive outer shell 114 and center conductor 116 at a second lead or end 128. A rear cap 120 encloses the rear of terminated coaxial connector 110.

In use, connector 110 is attached to a coaxial connector jack. Outer shell 114 contacts a ring conductor of the jack and center conductor 116 contacts a tip conductor of the jack. Resistor 124 electrically connects outer shell 114 and center conductor 116 to provide a return signal on the circuit connected to the jack. The level of impedance of this return signal is governed by resistor 124.

While resistor 124 may be inserted substantially axially aligned within outer shell 114, when second end 128 is connected to outer shell 114, resistor 124 becomes displaced from this axial alignment, often to such an extent that resistor 124 comes into contact with outer shell 114, as shown in FIG. 3. The connection between second end 128 and outer shell 114 is typically a physical and electrical connection such as a solder connection. Second end 128 may extend outside of outer shell 114 through a notch 132 and be received within a relief 130 in outer shell 114. In such a connection, rear cap 120 would serve to provide additional security to the physical and electrical connection between second end 128 and outer shell 114. It is very difficult to assemble a terminated connector such as coaxial connector 110 without displacing resistor 124 in the process of bending second end 128 and soldering second end 128 to outer shell 114 from the desired axial alignment shown. When such displacement occurs, the impedance provided by connector 110 will vary from the desired impedance. Resistor 124 may come into contact with outer shell 110, the solder joint between second end 128 and outer shell 114 may vary in the quality of electrical connection provided, placement of rear cap 120 about the completed solder joint may change the nature of the physical and electrical connection provided by the solder joint, all of which may cause unpredictable and undesirable changes in the level of impedance provided by connector 110.

FIGS. 4 through 7 show a terminated coaxial connector 10 in accordance with the present invention. Connector 10 including an axially aligned resistor 24. Connector 10 is a BNC style connector and defines a mating opening 12. Connector 10 further includes a cylindrical conductive outer housing 14, a center conductor 16 within mating opening 12 and a locking mechanism 18 about outer housing 14. An insulator 22 is mounted within outer housing 14 and provides a center axial channel 32 into which a center conductor 16 is mounted with a first end 36 extending into mating opening 12. Insulator 22 holds center conductor 16 axially aligned within outer housing 14 and electrically isolates center conductor 16 from outer shell 14. A first end 26 of resistor 24 is crimped onto a second end 34 of center conductor 16. A second end 28 of resistor 24 is inserted through and crimped to a rear plug 30. Rear plug 30 is mounted to an end of outer housing 14 opposite mating end 12 and is electrically conductive to provide an electrical path between resistor 24 and outer housing 14. A rear cap 20 in mounted over rear plug 30.

The crimped connection between second end 28 and rear plug 30, and the physical connection between outer housing 14 and rear plug 30 when rear plug 30 is mounted as shown in FIGS. 4 to 7 provide a consistent electrical connection between resistor 24 and outer housing 14. The crimping and physical connections do not require heating or soldering. Rear plug 30 supports resistor 24 so that resistor 24 remains in a consistent axially aligned position within outer housing 14. The quality of the connections and the consistent location of resistor 24 within connector 10 allow connector 10 to provide a predictable level of impedance when connector 10 is used to terminate an open circuit through a coaxial connector jack.

Also shown in FIGS. 4 through 7 are washers 38 and 42 and a wave washer 40, which cooperate to aid in the rotation and lateral movement of locking mechanism 18 about outer housing 14.

Figure 8:
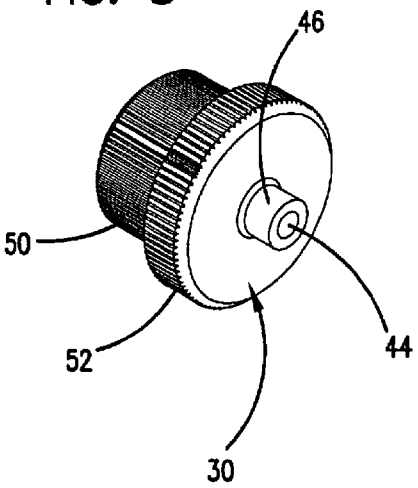
FIG. 8 is a rear perspective view of a rear plug for use with the terminated coaxial connector of FIG. 4.
Figure 10:
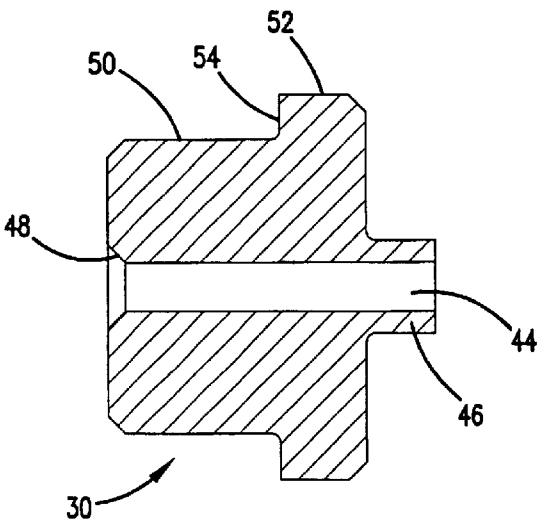
FIG. 10 is a cross-sectional view of the rear plug of FIG. 8, taken along line 10—10 in FIG.9.
Figure 9:
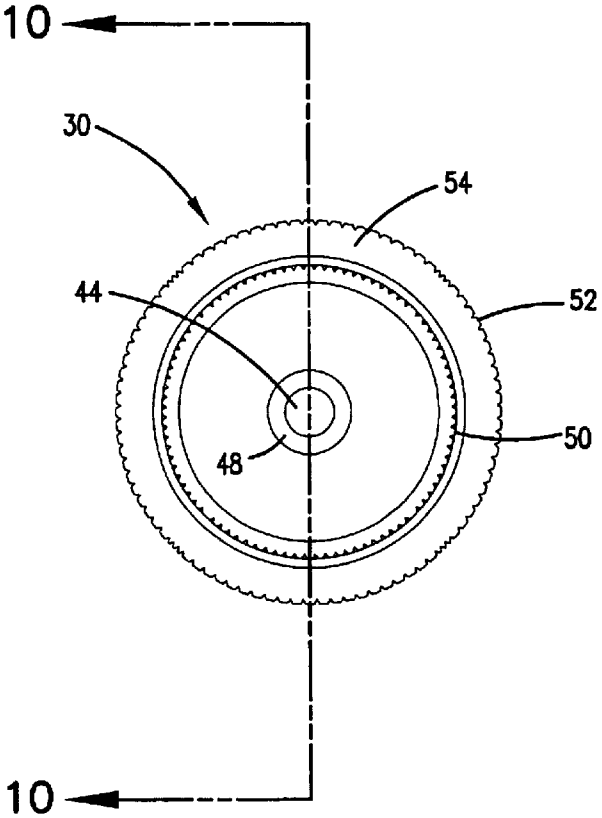
FIG. 9 is a front view of the rear plug of FIG. 8.

Referring now to FIGS. 8 through 10, additional details of rear plug 30 are shown. Rear plug 30 is made of an electrically conductive material and includes a central axial opening 44 through which is received second end 28 of resistor 24. A bevel 48 aids in the insertion of second end 28 into opening 44. Opposite bevel 48 is a crimp extension 46 which is compressed about second end 28 to crimp rear plug 30 to resistor 24. Rear plug 30 also includes a first wall 50 which is inserted within outer housing 14. First wall 50 may be knurled as shown to aid in insertion and improve the physical and electrical connection between rear plug 30 and outer housing 14. A lip 54 engages an end of outer housing 14 opposite mating end 12 and serves as a depth limiter for the insertion of rear plug 30 within outer housing 14. A second wall 52 has a greater diameter than first wall 50. Second wall 52 has a diameter approximately the same as a rear portion 68 of outer housing 14 and engages an interior wall 64 of rear cap 20, discussed in further detail below. Second wall 52 may also be knurled as shown to aid the insertion of rear cap 20 about rear plug 30 and rear portion 68 and improve the physical connection of rear cap 20 and rear plug 30.

Figure 11:
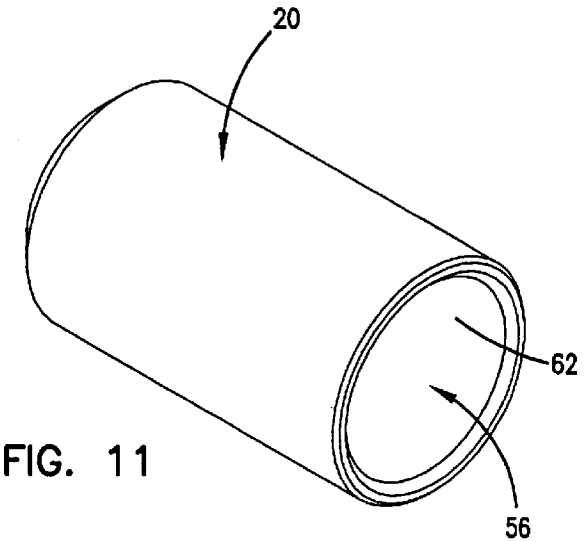
FIG. 11 is a front perspective view of an end cap for use with the terminated coaxial connector of FIG. 4.
Figure 13:
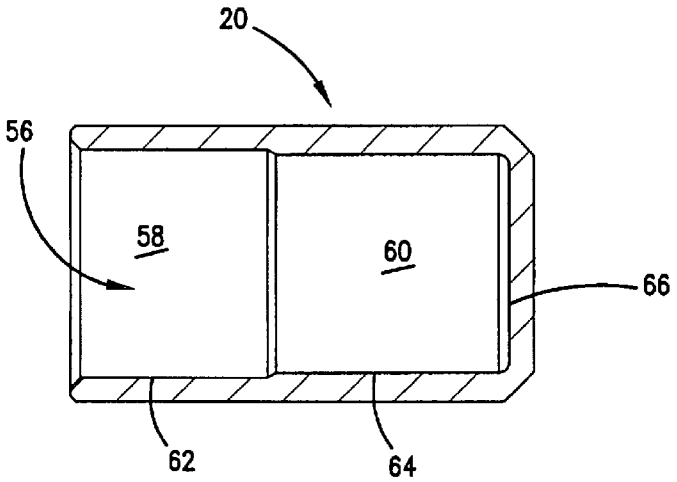
FIG. 13 is a cross-sectional view of the end cap of FIG. 11 taken along line 13—13 in FIG. 12.
Figure 12:
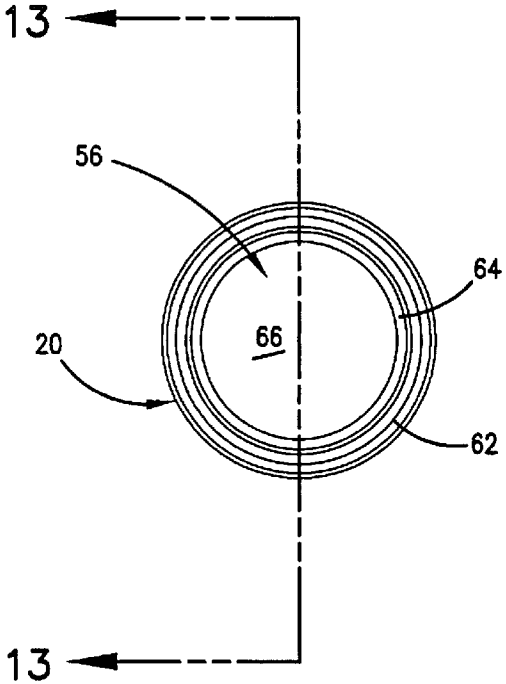
FIG. 12 is a front end view of the end cap of FIG. 1.
Figures 14, 15, 16, 17:
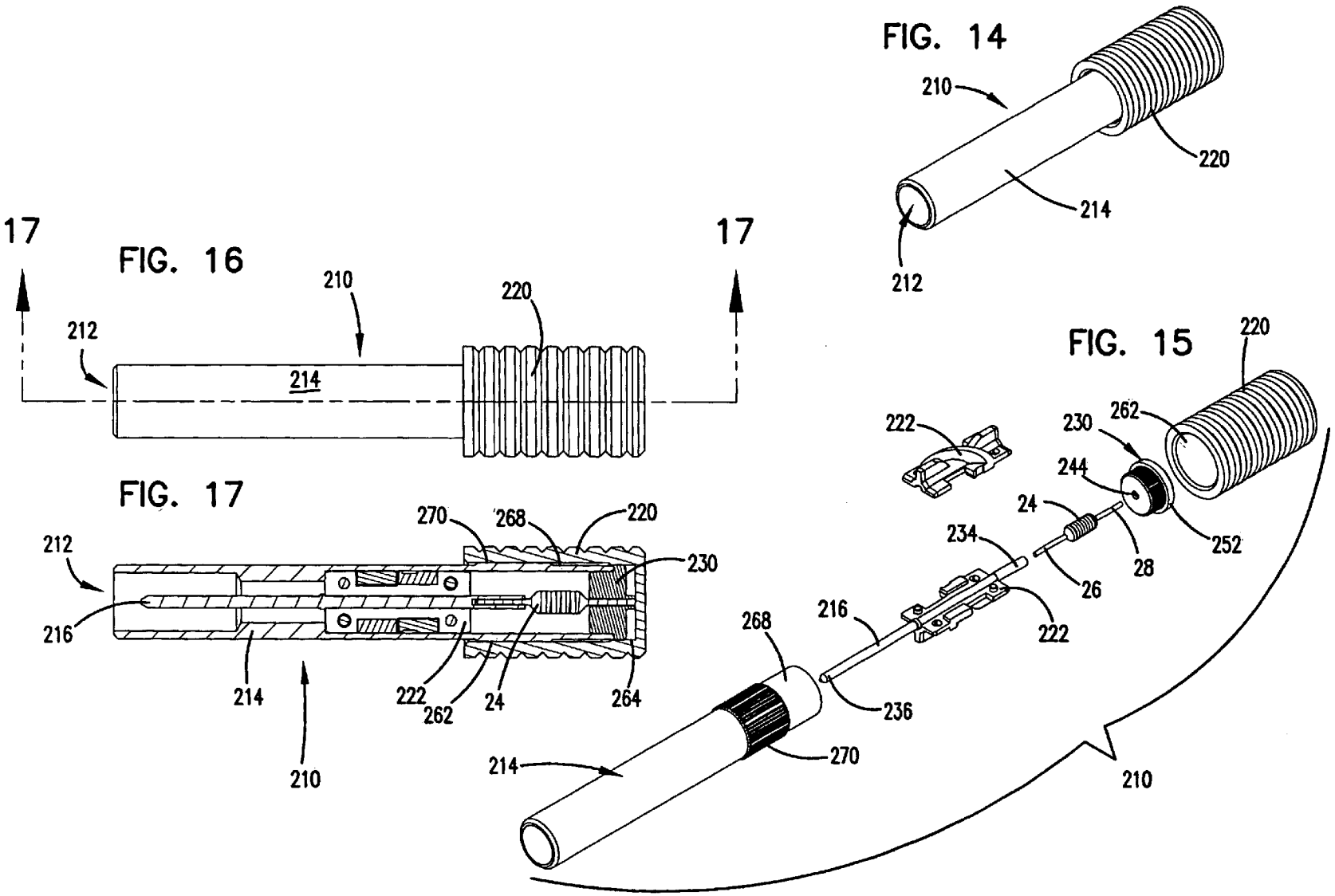
FIG. 14 is a front perspective view of a first alternative terminated coaxial connector in accordance with the present invention.
FIG. 15 is an exploded front perspective view of the terminated coaxial connector of FIG. 14.
FIG. 16 is a side view of the terminated coaxial connector of FIG. 14.
FIG. 17 is a cross-sectional view of the terminated coaxial connector of FIG. 14, taken along line 17—17 of FIG. 16.
Figure 18:
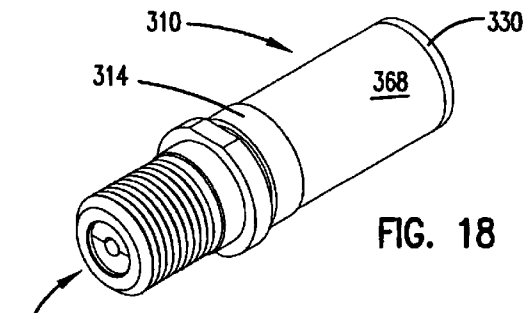
FIG. 18 is a front perspective view of a second alternative terminated coaxial connector is accordance with the present invention.
Figure 19:
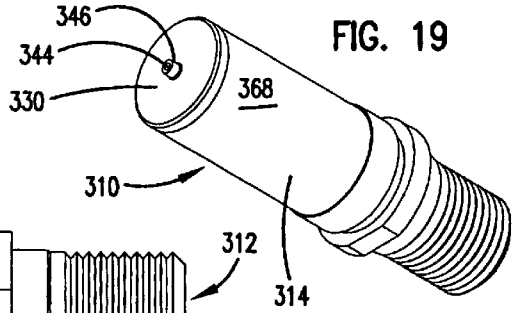
FIG. 19 is a rear perspective view of the terminated coaxial connector of FIG. 18.
Figure 20:
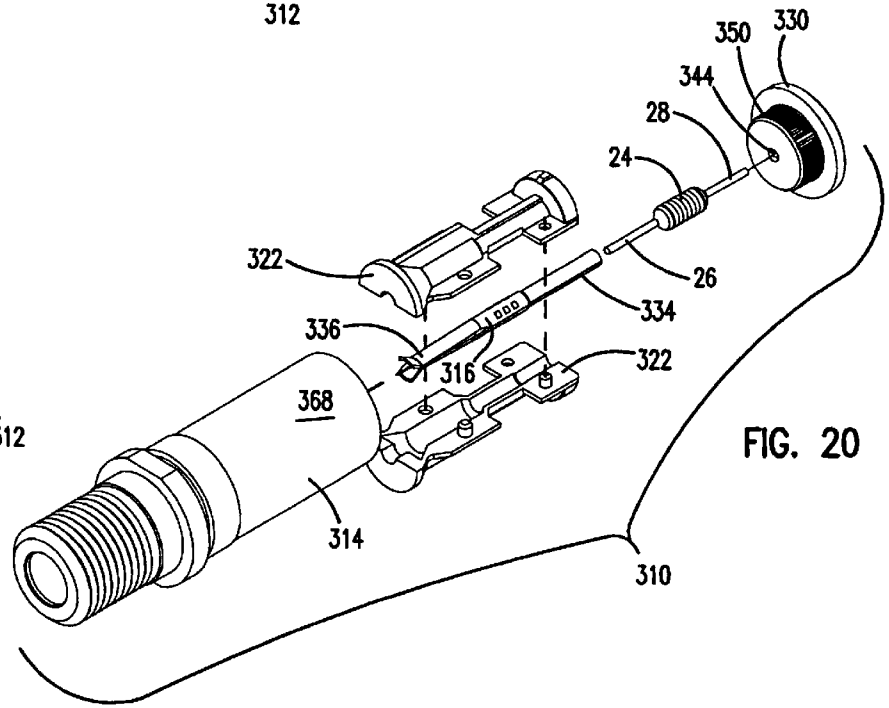
FIG. 20 is an exploded front perspective view of the terminate coaxial connector of FIG. 18.
Figure 21:
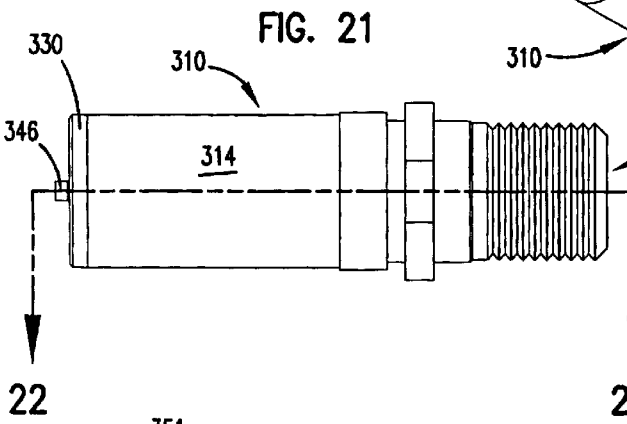
FIG. 21 is a side view of the terminated coaxial connector of FIG. 18.
Figure 22:
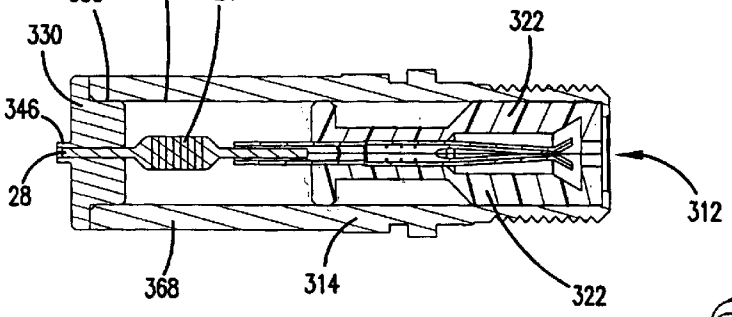
FIG. 22 is a cross-sectional view of the terminated coaxial connector of FIG. 18 taken along line 22—22 in FIG. 21.

FIGS. 11 through 13 show rear cap 20 including a cylindrical interior space 56 closed at one end by an end wall 66. Cylindrical interior 56 includes a first portion 58 enclosed by a wall 62 and a second portion 60 enclosed by wall 64. First portion 58 has a larger diameter than rear portion 68 and second wall 52. When positioned about outer housing 14 and rear plug 30 as shown in the earlier FIGS., inner wall 64, which has a marginally smaller diameter than second wall 52, engages rear plug 30 and is held to connector 10. It is contemplated that other combinations of inner diameters within rear cap 20 and outer diameters of outer housing 14 and rear plug 30 may be used to secure rear cap 20 about rear portion 68 of connector 10.

Referring now to FIGS. 14 through 17, a first alternative embodiment terminated coaxial connector 210 is shown, for use with WECO mid-size telecommunications jacks. The structure of connector 210 is substantially similar to that of connector 10, with several components having slightly different shapes to mate with the tip and ring contacts of the mid-size jack. A pair of insulator halves 222 centrally mount a center conductor 216 within an outer housing 214 so that a first end 236 is within a mating end 212. First end 26 of resistor 24 is crimped to a second end 234 of center conductor 216 and second end 28 is crimped within an opening 244 of a rear plug 230. Rear plug 230 is mounted within a rear portion 268 of outer housing 214 and a rear cap 220 is mounted about rear portion 268 so that a first interior wall 264 of rear cap 220 engages a second wall 252 of rear plug 230 and a second interior wall 262 of rear 230 engages a raised area 270 to secure rear cap 220 to connector 210.

Referring now to FIGS. 18 through 22, a second alternative embodiment terminated coaxial connector 310 is shown, for use with F-connector telecommunications jacks. The structure of connector 310 is substantially similar to that of connector 10, with several components having slightly different shapes to mate with the tip and ring contacts of the F-connector jack. A pair of insulator halves 322 centrally mount a center conductor 316 within an outer housing 314 so that a first end 336 is within a mating end 312. First end 26 of resistor 24 is crimped to a second end 334 of center conductor 316 and second end 28 is crimped at a crimp sleeve 346 within an opening 344 of a rear plug 330. Rear plug 330 is mounted within a rear portion 368 of outer housing 314 so that first wall 350 engages an interior wall 351 of outer housing 314. No rear cap is shown mounted to connector 314 although a rear cap could be adapted to fit about rear portion 368 similar to the previously disclosed embodiments.

Additional embodiments of terminated coaxial connectors in accordance with the present invention may be adapted for other standard or proprietary coaxial connector jacks. These other jacks include but are not limited to TNC, RCA, WECO standard size, MUSA mini and standard size, 7–16 DIN, N-format, 1.6/5.6 and LCJ jacks. The adaptations required to construct terminated coaxial connectors in accordance with the present invention will be similar to the adaptations made for the two alternative embodiments described above, wherein the mating end portion of the connector will be adapted to fit the jack, while the rear portion of the plug will include the outer housing or ring conductor, the resistor crimped to the center or tip conductor and a rear plug holding the resistor fixed axially within the housing.

A method of assembly of connector 10 may include inserting and press-fitting insulator 22 within outer housing 14, where friction will hold insulator 22 in place. First end 26 of resistor 24 is trimmed to a desired length, for example, in the illustrated embodiment of connector 10, first end 26 preferably extends approximately 0.20 inches from resistor 24. First end 26 is inserted within an opening in second end 34 of center conductor 16. Second end 34 of center conductor 16 is crimped about first end 26, securing and electrically connecting resistor 24 and center conductor 16. Second end 28 of resistor 24 is then placed within opening 44 of rear plug 30. The combination of center conductor 16, resistor 24 and rear plug 30 are then connected with outer housing 14 by inserting and press-fitting center conductor 16 within axial opening 32 of insulator 22 and inserting and press-fitting rear plug 30 into rear portion 68 of outer housing 14.

So assembled, resistor 24 is axially aligned within outer housing 14 and electrically connected to outer housing 14 by electrically conductive rear plug 30. Tension is then applied to second end 28 of resistor 24 to ensure that resistor 24 is not canted within outer housing 14. Crimp sleeve 46 of rear plug 30 is then compressed and crimped about second end 28 of resistor 24. Second end 28 is then trimmed substantially flush with crimp sleeve 46. So crimped at both ends, resistor 24 is now held axially aligned within outer housing 14 so that a consistent level of impedance can be provided by connector 10. Rear cap 20 is placed over rear portion 68 of connector 10 and secured in place. Rear cap 20 provides additional protection to the internal components of connector 10. Alternative assembly approaches are anticipated and suggested by the foregoing description within the scope of the present invention.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A coaxial connector comprising:

a conductive outer shell having a hollow core within which an insulator is mounted;

a center conductor mounted within the insulator substantially centered within the hollow core of the outer shell, a first end of the center conductor and a first end of the outer shell cooperating to define a mating end;

a first end of a resistor electrically connected to a second end of the center conductor;

a second end of the resistor connected to a conductive rear plug, the rear plug including a central axial opening extending through the rear plug and including a projecting outer end defining a crimp sleeve, with the second end of the resistor extending through the central axial opening and into the crimp sleeve of the rear plug;

the resistor extending substantially axially within the hollow core of the outer shell;

the rear plug mounted at least partially within the outer shell opposite the mating end and electrically connecting the second end of the resistor to the outer shell.

2. The coaxial connector of claim 1, further comprising an a rear cap adapted to fit about the rear plug and the outer shell.

3. The coaxial connector of claim 1, wherein the insulator is a single piece insulator and the center conductor is press-fit within a center axial opening through the insulator.

4. The coaxial connector of claim 1, wherein the insulator is a two piece insulator with the two pieces cooperating to form a central axial opening within which the center conductor is placed.

5. The coaxial connector of claim 4, wherein the two pieces of the insulator are identical.

6. The coaxial connector of claim 1, wherein the mating end is adapted to mate with a coaxial jack.

7. The coaxial connector of claim 6, wherein the mating end is adapted to mate with one of a BNC jack, a TNC jack, an F-connector jack, a WECO mid-size patch jack, and an RCA jack.

8. The coaxial connector of claim 2, wherein the rear plug includes a rear portion extending outside the outer shell, the rear portion having a diameter larger than an inner diameter of the outer sleeve, and an interference fit between the rear portion of the rear plug and the inner diameter of the rear cap holds the rear cap to the outer shell.

9. A method of assembling a coaxial connector comprising the steps of:

inserting an insulator within a hollow core of a connector housing;

crimping a first lead of a resistor to a second end of a center conductor;

placing a second lead of the resistor through a central axial opening extending through a rear plug, the axial opening including a projecting outer end defining a crimp sleeve with the second lead extending through the opening into the crimp sleeve;

inserting a first end of the center conductor within a central axial opening defined through the insulator so that a first end of the connector housing and the first end of the center conductor define a mating end;

engaging a second end of the connector housing with the rear plug; and the center conductor and the rear plug cooperating to hold the resistor is axially aligned within the hollow core of the connector housing; and crimping the second lead of the resistor to the rear plug.

10. The method of claim 9, wherein the second lead of the projecting crimp sleeve of the rear plug is crimped about the second lead.

11. The method of claim 10, further comprising the step of tension is applied to the second lead of the resistor prior to crimping the second end of the resistor to the rear plug to ensure that the resistor is axially aligned within the connector housing.

12. The method of claim 10, further comprising the step of trimming the second lead of the resistor substantially flush with an outer end of the rear plug after crimping the second lead the rear plug.

13. The method of claim 9, further comprising the placing of an end cap about the rear plug and an opposite second end of the connector housing.

* * * * *

UNITED STATES PATENT AND TRADEMARK OFFICE

CERTIFICATE OF CORRECTION

PATENT NO. : 6,712,647 B2
DATED : March 30, 2004
INVENTOR(S) : Khemakhem et al.

It is certified that error appears in the above-identified patent and that said Letters Patent is hereby corrected as shown below:

Column 2,
Line 12, "FIG. 1." should read -- FIG. 11. --

Column 6,
Lines 9-10, "comprising an a rear cap" should read -- comprising a rear cap --
Lines 51-52, "wherein the second lead of the projecting" should read -- wherein the projecting --
Line 62, "second lead the" should read -- second lead to the --

Signed and Sealed this

Ninth Day of November, 2004

JON W. DUDAS
*Director of the United States Patent and Trademark Office*